United States Patent [19]

Okawada et al.

[11] Patent Number: 4,735,550

[45] Date of Patent: Apr. 5, 1988

[54] TURBO MOLECULAR PUMP

[75] Inventors: Takeshi Okawada, Ibaraki; Shinjiro Ueda, Abiko; Susumu Yamazaki, Tsuchiura; Masahiro Mase, Tochigi; Nobukatsu Arai, Ushiku; Kazuaki Nakamori, Ibaraki, all of Japan

[73] Assignee: Hitachi, Ltd., Tokyo, Japan

[21] Appl. No.: 890,610

[22] Filed: Jul. 30, 1986

[30] Foreign Application Priority Data

Jul. 31, 1985 [JP] Japan ..... 60-167571
Aug. 21, 1985 [JP] Japan ..... 60-181719

[51] Int. Cl.[4] ..... F04D 5/00
[52] U.S. Cl. ..... 415/53 T; 415/76
[58] Field of Search ..... 415/53 T, 90, 213 T, 415/76, 198.2

[56] References Cited

U.S. PATENT DOCUMENTS 2,918,208 12/1959 Becker ..... 415/90
3,481,148 12/1969 Muller et al. ..... 415/213 T X
3,849,024 11/1974 Masai et al. ..... 415/53 T X
3,917,431 11/1975 Rose ..... 415/53 T
4,270,882 6/1981 Luijten et al. ..... 415/90 X
4,474,530 10/1984 Coffinberry ..... 415/53 T

FOREIGN PATENT DOCUMENTS 578497 11/1977 U.S.S.R. ..... 415/198.2

*Primary Examiner*—Robert E. Garrett
*Assistant Examiner*—Joseph M. Pitko
*Attorney, Agent, or Firm*—Antonelli, Terry & Wands

[57] ABSTRACT

According to the turbo molecular pump of the present invention, a regenerative pump is constructed by arcuate eddy current grooves having a predetermined angle with respect to the surface of the outer periphery of a rotor and which are circumferentially engraved in array in the rotor and an arcuate ventilating channel engraved in the circumferential direction in a stator, and a partition is defined in the stator circumferentially partitioning the ventilating channel, so that the working range on the low vacuum side may be extended.

3 Claims, 5 Drawing Sheets

FIG. 9
FIG. 8
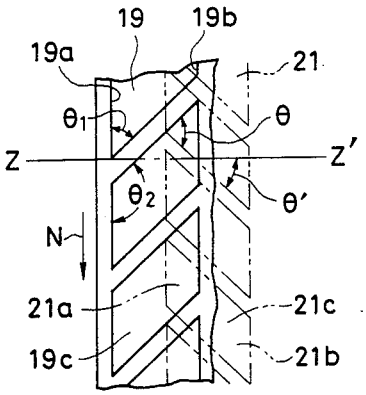
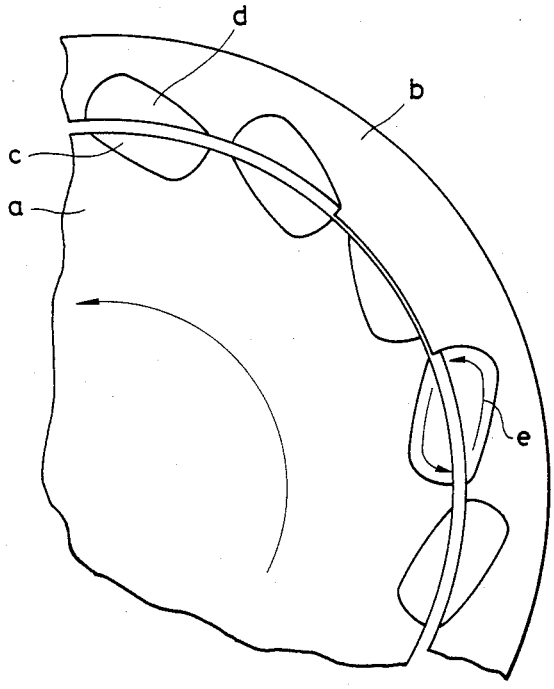
FIG. 10
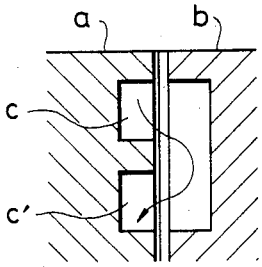
FIG. 11
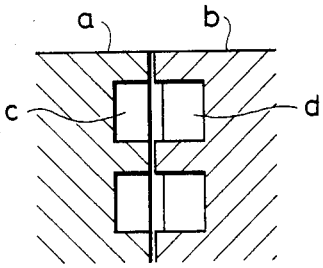

TURBO MOLECULAR PUMP

BACKGROUND OF THE INVENTION

1. Field of the Invention

The present invention relates to a turbo molecular pump and more particularly to a turbo molecular pump in which the working range at the low vacuum side is extended.

2. Description of the Invention

In the prior turbo molecular pump, an axial flow blade which exhibits an excellent evacuating performance in the region of the molecular flow is used. However, this type of turbo molecular pump has a disadvantage that, when the pressure has attained $10^{-3}$ to $10^{-2}$ Torr or above, the pumping speed is rapidly reduced. Consequently, in case this type of pump is used as the exhaust pump in a process of making a semiconductor with the dry etching method in which a high vacuum on the order of $10^{-8}$ to $10^{-6}$ Torr and a low vacuum $10^{-2}$ to $10^{-2}$ Torr are repeatedly employed in a short time, since the pumping speed is small in the low vacuum, the exhaust time which is required to go from the low vacuum state to the high vacuum state is long. This has precluded improvement of the throughput. To eliminate the above described disadvantage, a composite type of turbo molecular pump has been proposed in which an axial flow molecular pump as described in U.S. Pat. No. 2,918,208 and a spiral grooved molecular pump as described in U.S. Pat. No. 4,270,882 are combined. Such a pump extends the region in which the pumping speed is reduced to the low vacuum region ranging from $10^{-1}$ to $10^{-2}$ Torr. However, even in this composite pump, a sufficient pumping speed is not obtained in the region of the viscous flow above the $10^{-1}$ Torr and a turbo molecular pump having a large pumping speed up to 10 Torr has been desired.

SUMMARY OF THE INVENTION (1) Object of the Invention

An object of the present invention is therefore to provide a turbo molecular pump in which the working range at the low vacuum is extended.

(2) Statement of the Invention

The present invention is characterized in that, in the turbo molecular pump which performs the evacuating action by groups of the grooves respectively disposed on a cylindrical rotor extending in a casing in the direction of the axial line thereof and on the stator opposed to a surface of the outer periphery of this rotor, an eddy current pump is composed of a plurality of the regenerative grooves having the arcuate cross section which constitute a specific angle to the axis of the rotor at the surface of the outer periphery of the rotor and which are engraved in the circumferential direction and a ventilating channel having the arcuate cross section which is engraved in the circumferential direction of the stator with respect to the eddy current grooves, while a cylindrical partition for partitioning the ventilating channel in the circumferential direction with a slight clearance with the eddy current grooves is defined on the stator opposed to the regenerative grooves, so that one of both sides of the partition may serve as a suction port at which the molecular flow flows into the regenerative pump and the other may be an exhaust port.

In the above-described construction, when the rotor is driven at a high speed, the eddy current is caused between the eddy current grooves provided on the rotor and the ventilating channel provided on the stator, and the process in which the velocity head imparted to the air molecules by the eddy current grooves is converted into the static pressure head by the ventilating channel is repeated around the suction port to the exhaust port of the regenerative pump which is constituted by the eddy current grooves and the ventilating channel, thus the exhaust action being performed. Consequently, even if the suction pressure has attained the pressure in the range of the viscous flow which is in the extent of 0.1 Torr to 10 Torr, the reduction of the pumping speed can be suppressed thanks to the principle of the regenerative compressor, which allows the working range of the vacuum side to be extended.

The present invention further includes a turbo molecular pump which performs the evacuating action by a group of multistage blades respectively disposed on the cylindrical rotor extending within the casing in the direction of the axial line thereof and on the stator located at the surface opposed to this rotor, a plurality of the wedge-shaped regenerative grooves are circumferentially disposed respectively on the surface of the outer periphery of the rotor and on the surface of the inner periphery of the stator opposed thereto, a cylindrical partition is provided with a slight clearance between itself and the rotor by defining adjacent regenerative grooves at a portion taken in the circumferential direction of the stator, so that regenerative grooves on one of the two sides of the partition may communicate with the suction stage and ones on the other may communicate with the exhaust stage.

BRIEF DESCRIPTION OF THE DRAWINGS

FIG. 8 shows a developed view, taken along the line I—I of FIG. 7, FIG. 9 shows an explanatory view of the evacuating action of the embodiment of FIG. 7, FIG. 10 shows a cross sectional view, illustrating the eddy current groove which communicates with the exhaust stage, FIG. 11 shows a cross sectional view, illustrating the eddy current groove at the portion other than the partition.

DESCRIPTION OF THE PREFERRED EMBODIMENTS

Figure 1:
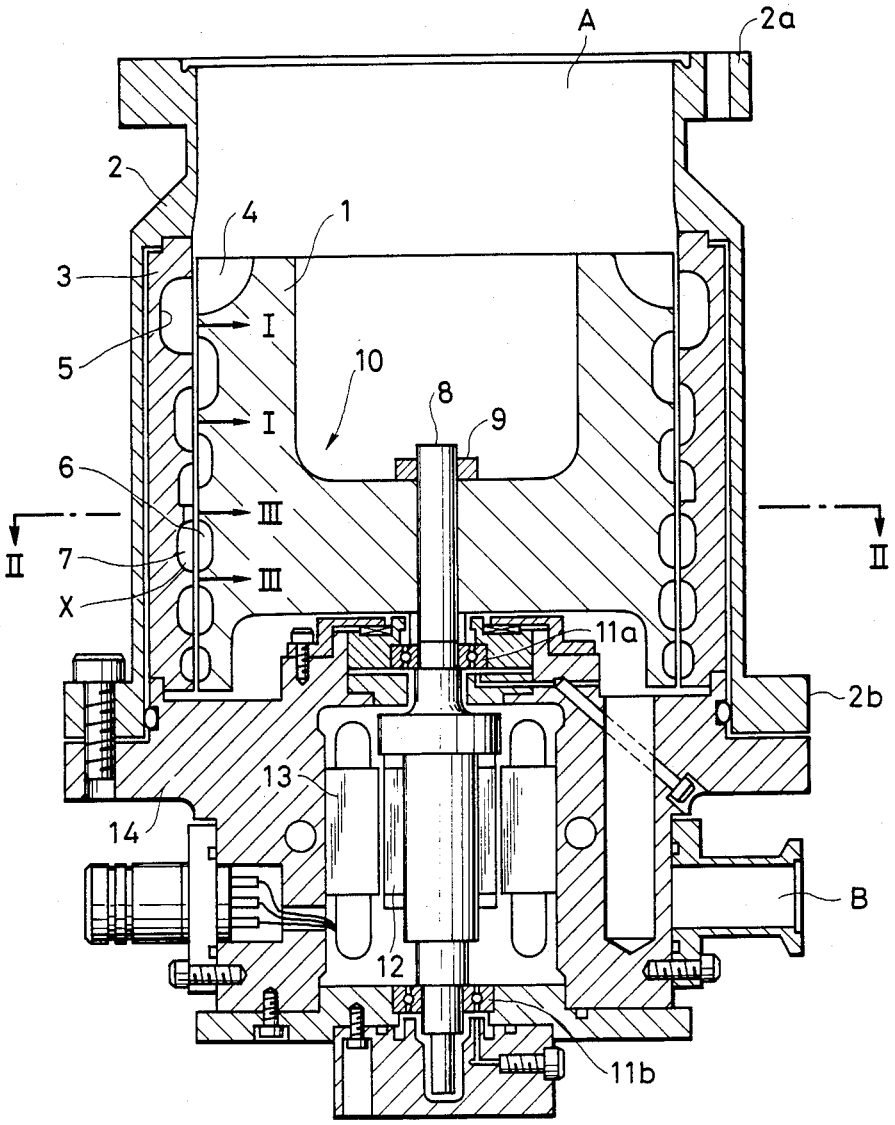
FIG. 1 shows a longitudinal cross section of one embodiment of the turbo molecular pump according to the present invention.

Referring to FIG. 1, the cylindrical rotor 1 is disposed within the casing 2, so that it may extend in the direction of the axial line thereof. The stator 3 is disposed opposed to this rotor 1 and is fixed to the casing 2. The groove 4 for the moving blade is engraved in the rotor and the groove for the stationary blade is engraved in the stator 3 opposed thereto, so that a compound flow pump may be constituted.

The regenerative groove 6 having an arcuate cross section is engraved in the understream rotor 1 and the ventilating channel 7 having an arcuate cross section is also engraved in the stator to which this regenerative groove 6 opposes, so that the regenerative pump may be constituted. The rotor 1 is integrally fixed to a rotary shaft 8 by means of a nut 9, constituting a rotary body 10. The rotary shaft 8 is supported by bearings 11*a* and 11*b*. To this rotary shaft 8 is provided a rotor 12 of a motor and a stator 13 of the motor opposed thereto is mounted to an exhaust casing 14 provided with an exhaust port B. Furthermore, a suction port A is provided on the upper portion of the casing 2 and a vacuum unit which is evacuated is coupled thereto by a flange 2*a*. The lower portion of the casing 2 is coupled via flange 2*b* to the exhaust casing 14.

Figure 2:
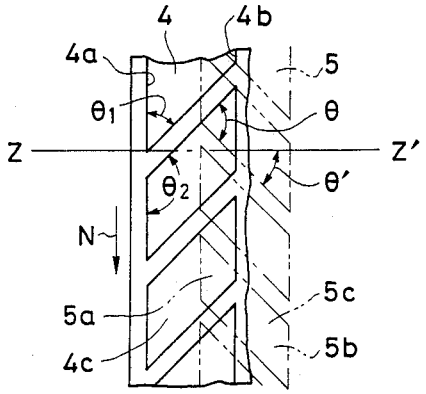
FIG. 2 shows a developed view, taken along the line of I—I of FIG. 1.

As shown in FIG. 2, the groove 4 of the moving blade is engraved in the surface of the outer periphery of the rotor 1, so that it may be inclined at an angle of $\theta_1$ relative to the axis Z—Z' of the rotor and a front edge 4*a* and a trailing edge 4*b* taken in the axial direction are circumferentially defined. Consequently, the angle $\theta_1$, becomes an acute angle (15 degrees in the figure) and $\theta_2$ an obtuse angle. The groove 5 of the stationary blade is defined at an angle of $\theta'$ relative to the axis of rotation Z–Z' of the rotor in the direction opposite to that of the groove 4 of the moving blade and further in such a way that a portion thereof may be axially overlapped with the groove 4 of the moving blade. Further, the front end portions 4*a* and 5*a* and the trailing end portions 4*b* and 5*b* the grooves 4 and 5 of the moving blade and the stationary blade, respectively, are each connected by a smooth curved surface toward the bottom surface 4*c* of the grooves.

Figure 3:
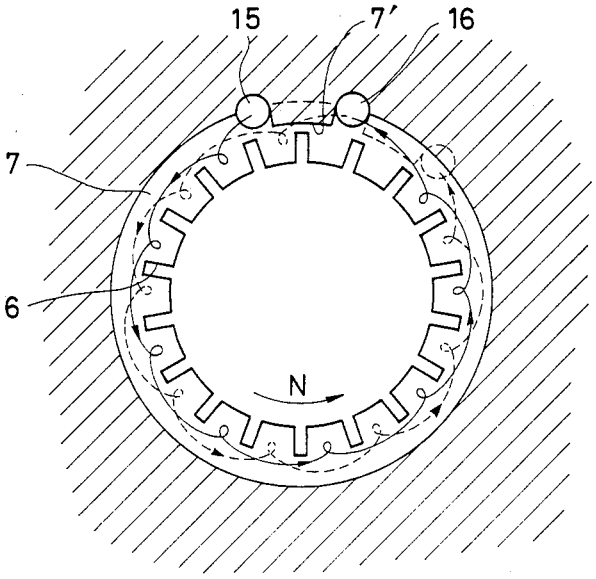
FIG. 3 shows a cross sectional view, taken along the line II—II of FIG. 1.
Figure 4:
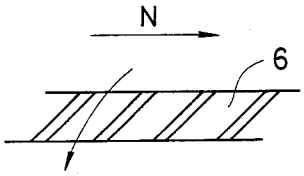
FIG. 4 shows a developed view, taken along the line III—III of FIG. 1.
Figure 5:
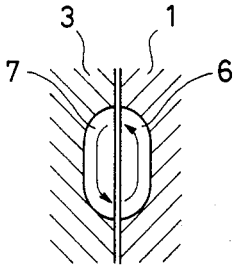
FIG. 5 shows an enlarged view of the portion X of FIG. 1.

Next, the cross sectional view taken along the line II—II of FIG. 1, which is a detailed view of the regenerative portion, is shown in FIG. 3. As shown in FIG. 4, the regenerative grooves 6 form an acute angle (45 degrees in this case) relative to the axis of the rotor 1 and are arrayed in a plural number in the circumferential direction. Their configuration, as shown in FIG. 5, is arcuate in cross section with a central portion of the groove deepened.

The cylindrical partition 7' which circumferentially partitions the ventilating channel 7 with a slight clearance between itself and the regenerative groove 6 is defined on the stator 3 opposed to the regenerative groove 6. On the one side of this partition 7' is the suction port 15 into which the molecular flow flows and on the other is provided the exhaust port 16.

In the above-described arrangement, if the electric current is fed to the stator 13 of the motor, the rotary body 10 is started and is rotated at a high speed via the rotor 12 of the motor.

The air molecules flying toward the groove 4 of the moving blade from the suction port A strike against the bottom surface and further side surface of the groove of the moving blade and are irregularly reflected, so that the direction may be imparted to them by the amount by which the rotor 1 is moved.

After the air molecules which have flown directionally out of the groove 4 of the moving blade strike against the bottom surface and the side surface of the stationary blade, they are irregularly reflected, so that a great part of them may plunge into the groove 4 of the moving groove at the next stage. While the stream of the air molecules radially repeats the entry and exit, it is axially moved to be introduced to the stage of the regenerative pump.

At this stage of the regenerative pump, the stream of the air molecules passes through the suction port 15, moves circumferentially in the form of eddy current by the regenerative groove 6 and the ventilating channel 7 to be introduced to the exhaust port 16 and is successively introduced to the regenerative pump at the next stage, being finally exhausted from the exhaust port B.

The eddy current at the stage of the regenerative pump occurs between the regenerative groove 6 which is provided on the rotor 1 and the ventilating channel 7 which is provided on the stator 3. As shown in FIG. 3, this current advances in the rotating direction. The process in which the velocity head imparted at the regenerative groove 6 to the air molecules is converted into the stationary pressure head in the ventilating channel 7 provided on the stator 3 is repeated, elevating the pressure of the air molecules.

Figure 6:
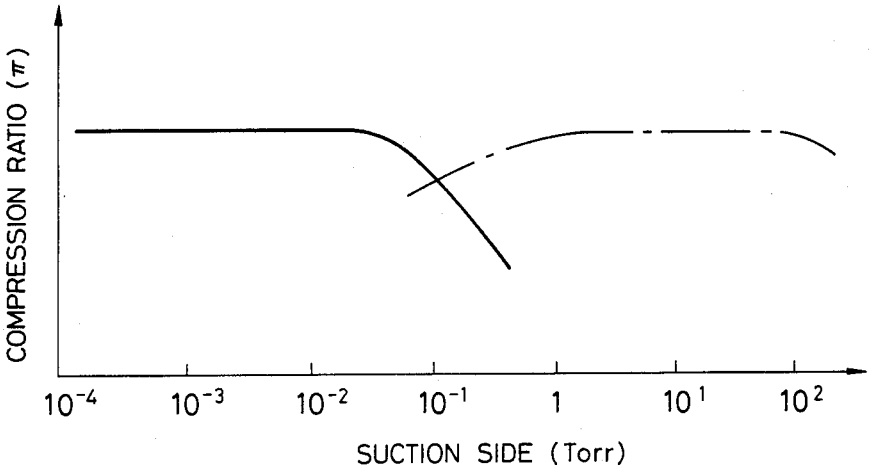
FIG. 6 shows a characteristic view of the turbo molecular pump of FIG. 1.

The above-described exhaust action at the stage of the regenerative pump is effectively conducted in the region of the viscous flow on the order of 0.1 Torr. Consequently, even if the suction pressure of the turbo molecular pump has attained 0.1 Torr to 10 Torr which is prevalent in the viscous flow, the eddy current pump stage can detect the reduction of the evacuating speed thanks to the evacuating action based on the principle of the eddy current blower. FIG. 6 shows a relationship between the pressure on the suction side (Torr) and the compression ratio ($\pi$). Since the evacuating action is performed by the compound flow pump stage around $10^{-1}$ Torr indicated by the solid line and in the further region of the viscous flow, the evacuating action is performed by the regenerative pump stage, as shown by the one dot chain line, the working range can be by far extended than the conventional turbo molecular pump.

Next, a second embodiment of the invention is described.

Figure 7:
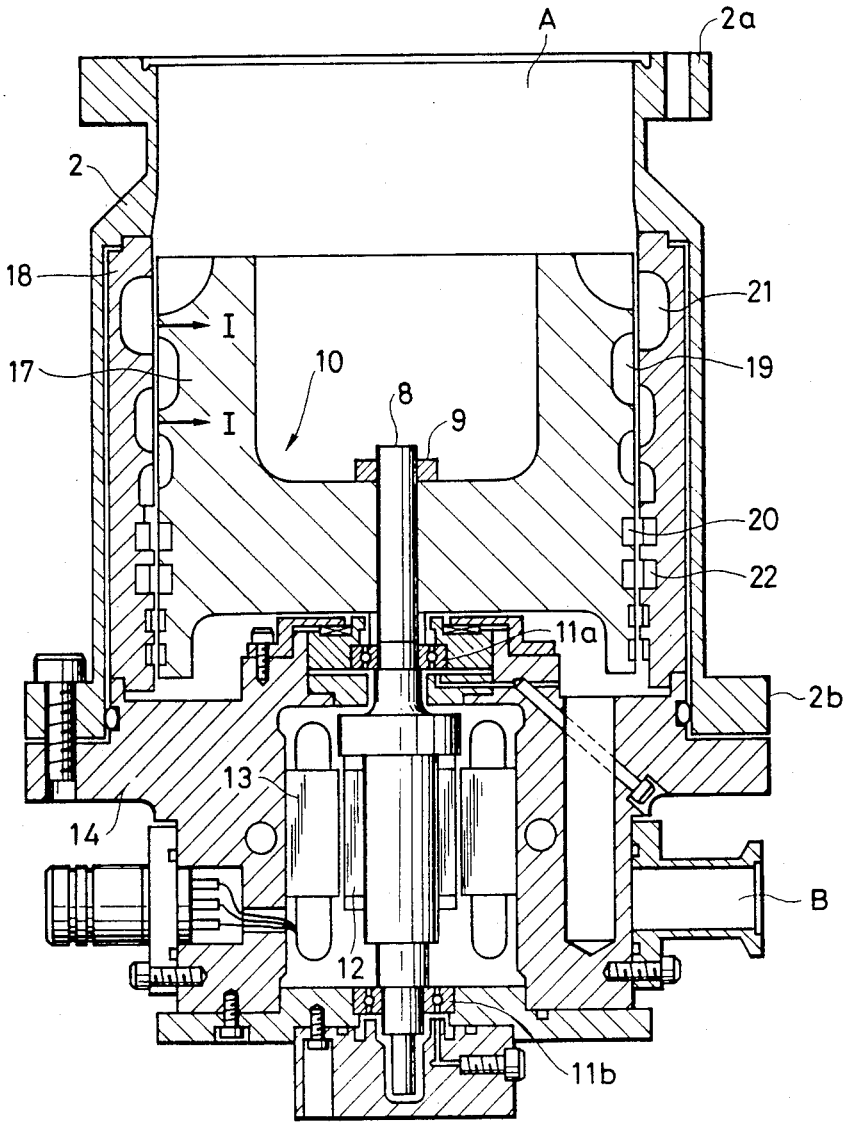
FIG. 7 shows a longitudinal view of the other embodiment according to the present invention.

In FIG. 7, the cylindrical rotor 17 is disposed within the casing 2 and extends in the direction of the axial line thereof. The stator 18 is disposed on the surface opposed to this rotor 17 and is mounted to the casing 2. In the rotor 17 is engraved the groove 19 of the moving blade on the suction side and the wedge-shaped eddy current groove 20 on the exhaust side, while on the stator 18 opposed thereto are the groove 21 of the stationary blade on the suction side and the wedge-shaped eddy current groove 22 on the exhaust side. As shown in detail in FIG. 8, the groove 19 of the moving blade is engraved in the surface of the outer periphery of the rotor 17, so that it may be inclined at an angle $\theta_1$ to the axis Z to Z' of the rotor and its front edge 19*a* and trailing edge 19*b* viewed in the axial direction are circumferentially defined. Consequently, the angle $\theta_1$, becomes an acute angle (15 degrees in this case) and $\theta_2$ an obtuse angle. The groove 21 of the stationary groove is defined at an angle of $\theta_1$ to the axis Z–Z' of the rotor in the direction opposite to the groove 19 of the moving blade and further in such a way that its portion may be axially overlapped with the groove 19 of the moving blade. Furthermore, grooves 19 and 21 of the moving blade and the stationary blade 21, respectively, are each connected by a smoothly curved surface from their front end portions 19*a* and 21i a or trailing end portions 19*b* and 21*c* toward bottom surfaces 19*c* and 21*b* of the grooves. Since grooves 19 and 21 of the moving blade and the stationary blade thus constructed have both actions which the axial flow blade and the molecular pump having the spiral grooves have, a high compression ratio and a large pumping speed can be expected. In the above-described construction, if the rotor 17 is driven at a high speed in the direction of N, the air molecules are evacuated from the suction port A to the exhaust port, so that a vacuum chamber which is connected via the connection flange 2*a* can be set to a highly vacuum condition.

FIG. 9 shows an explanatory view of the evacuating action of the second embodiment in which a plurality of the wedge-shaped regenerative grooves c and d are circumferentially provided on the surface of the outer periphery of the rotor a and the surface of the outer periphery of the slator b, performing the evacuating action by causing the eddy current as shown by the arrow. Namely, the velocity head imparted to the fluid at the wedge-shaped regenerative groove c provided on the rotor a is converted into the stationary pressure head by the wedge-shaped regenerative groove d provided on the stator b to raise the pressure, while the vortex is advanced in the rotating direction to evacuate the air. FIG. 10 shows a cross section of the eddy current groove d communicating with the evacuating state. FIG. 11 shows a cross section opposed to the regenerative groove c and d other than at the partition.

What is claimed is;

1. A turbo molecular pump, wherein the evacuating action is performed by groups of grooves engraved respectively in a cylindrical rotor extending in the axial direction thereof in a casing and in the surface of the stator opposed to the surface of the outer periphery of said rotor, characterized in that a regenerative pump is constructed of a plurality of the regenerative grooves having an arcuate cross section which form an acute angle relative to the axis of said rotor and which are circumferentially engraved in the surface of the outer periphery of said rotor and a ventilating channel having an arcuate cross section which is circumferentially engraved in said stator opposed to said regenerative grooves, while a cylindrical partition is defined which circumferentially partitions said ventilating channel with a slight clearance with respect to the opposed regenerative grooves, so that one of the two sides of said partition may be formed as a suction port into which the molecular stream flows and the other may be an exhaust port, and wherein a compound flow pump, which is composed of a plurality of grooves of a moving blade which form an acute angle relative to the axis of said rotor and which are circumferentially arrayed in the surface of the outer periphery of said rotor and grooves of a stationary blade which are arrayed in the surface of said stator opposed to said rotor in a manner that the latter grooves may form an angle in the opposite direction relative to said axis of said rotor, is disposed on the forward step of the regenerative pump which is composed of said regenerative grooves and said ventilating channel.

2. A turbo molecular pump, wherein the evacuating action is performed by a group of multistage blades disposed respectively on the cylindrical rotor extending in the axial direction in a casing and on a stator disposed on the surface opposed to said rotor, characterized in that a plurality of wedge-shaped regenerative grooves are circumferentially disposed respectively in said surface of the outer periphery of said rotor and in the surface of the inner periphery of said stator opposed thereto and that a partition forming a cylindrical surface with a slight clearance toward said rotor is provided to section adjacent regenerative grooves, one of the two sides of said partition communicating with the stage on the suction side and the other communicating with the stage on the evacuating side.

3. A turbo molecular pump, as defined in claim 2, wherein a compound flow pump, which is composed of a plurality of grooves of a moving blade which form an acute angle relative to the axis of rotation of said rotor and which are circumferentially arrayed in the surface of the outer periphery of said rotor and grooves of a stationary blade which are arrayed in the surface of said stator opposed to said rotor in a manner that the latter grooves may form an angle in the opposite direction relative to the axis of said rotor, is disposed on a forward step of the regenerative pump which is composed of said regenerative grooves and said ventilating channel.

* * * * *